US009114511B1

(12) United States Patent
Wang

(10) Patent No.: US 9,114,511 B1
(45) Date of Patent: Aug. 25, 2015

(54) RATCHET CONNECTOR

(71) Applicant: Chien-Kang Wang, Tainan (TW)

(72) Inventor: Chien-Kang Wang, Tainan (TW)

(73) Assignee: Lichten Tools Corporation, Tainan (TW)

( * ) Notice: Subject to any disclaimer, the term of this patent is extended or adjusted under 35 U.S.C. 154(b) by 60 days.

(21) Appl. No.: 14/188,527

(22) Filed: Feb. 24, 2014

(51) Int. Cl.
*B25B 13/46* (2006.01)

(52) U.S. Cl.
CPC ..... *B25B 13/465* (2013.01); *B25B 13/463* (2013.01)

(58) Field of Classification Search
CPC B25B 13/463; B25B 23/0035; B25B 13/465; B25B 15/04; B25B 13/466
USPC ..... 81/60–63.2
See application file for complete search history.

(56) References Cited

U.S. PATENT DOCUMENTS 3,290,969 A * 12/1966 Bergquist et al. ..... 81/63.1
5,105,688 A * 4/1992 Williams, III ..... 74/810.1
5,568,751 A * 10/1996 Lee ..... 81/63
6,070,499 A * 6/2000 Wisbey ..... 81/57.29
6,263,768 B1 * 7/2001 Huang et al. ..... 81/63
6,311,584 B1 * 11/2001 Chu ..... 81/57.29
6,457,386 B1 * 10/2002 Chiang ..... 81/62
6,925,910 B2 * 8/2005 Alford ..... 81/57.29
7,004,052 B1 * 2/2006 Shu-Sui et al. ..... 81/63
7,267,033 B1 * 9/2007 Lai ..... 81/57.29
7,938,042 B2 * 5/2011 Hu ..... 81/62
8,230,764 B1 * 7/2012 Lee ..... 81/63
2007/0277652 A1 * 12/2007 Tuan-Mu ..... 81/63

* cited by examiner

*Primary Examiner* — Lee D Wilson
*Assistant Examiner* — Danny Hong
(74) *Attorney, Agent, or Firm* — Che-Yang Chen; Law Office of Michael Chen

(57) ABSTRACT

A ratchet connector may include a first body, a ratchet, a control ring and a second body. The first body has a cylinder at one end and a semi-circular trough formed at an outer surface of the cylinder and a through hole at the semi-circular trough. The ratchet has a teeth portion on both sides of an arc surface thereof, a sliding surface formed between two teeth portions, a shaft rod configured to be insert into the through hole to enable the ratchet to be pivotally disposed in the semi-circular trough. The control ring having a fixed trough and a switching trough and the control ring disposed onto the cylinder of the first body to enable the switching trough to be disposed against the ball; and the second body having a receiving space and a ring teeth portion is formed inside the receiving space.

6 Claims, 8 Drawing Sheets

RATCHET CONNECTOR

FIELD OF THE INVENTION

The present invention relates to a ratchet connector, and more particularly to a ratchet connector that is easy to assemble and can sustain high torque.

BACKGROUND OF THE INVENTION

A conventional ratchet mechanism such as in Taiwanese Patent Number M369979, titled "Ratchet Driving Mechanism" disclosing a ratchet with direction changing function, which includes a main body, one end of which has a connecting base; a stopping body is formed on one side of the connecting base and the other side of the connecting base has two slots, and each slot receives a plug that is supported by a spring; a adjusting ring covers the outer portion of the connecting base and one side of the inner portion of the adjusting ring has a trough. Inner portion of the adjusting ring also has two adjusting slots provided for two plugs and a guiding surface is disposed at each adjusting slot; and a connecting body pivotally disposed at one end of the connecting base and an inner teeth ring is pivotally disposed at outer portion of the connecting base and inner teeth ring has a teeth portion that can be engaged with the plug. However, the structure of this ratchet mechanism is complicated and has too many components during the assembling process, which may significantly increase the manufacturing costs.

Another conventional ratchet mechanism is disclosed in Taiwanese Patent Number M335770, titled "Ratchet Device" including a ratchet and a connector. The connector has a plugging hole so the ratchet can be received therein. A plurality of ratchet teeth inside the periphery of the plugging hole and the head portion of the ratchet has a cut trough to receive a stopping block, a spring and a rotation block. A control ring is disposed outside the head portion and the control ring has a spring and a ball to control the rotation direction of the control ring. The stopping block has two sliding surfaces to attach to the cut trough. The other side of the stopping block has a plurality of outer ratchet teeth to connect with the connector. This ratchet device is disadvantageous because the stopping block can move inside the cut trough and when sustaining a larger torque, the teeth portion of the stopping block may break. Therefore, there remains a need for a new and improved ratchet connector to overcome the problems presented above.

SUMMARY OF THE INVENTION

The present invention provides a ratchet connector may include a first body, a ratchet, a control ring and a second body. The first body has a cylinder at one end and a screw hole is formed on a top surface of the cylinder. A semi-circular trough is formed at an outer surface of the cylinder and a through hole that has the same axial direction as the cylinder is formed at the semi-circular trough, and a through aperture is formed to orderly receive a spring and a ball. The other end of the cylinder has a polygonal rod to connect to a sleeve (not shown). The ratchet is fan-shaped and has a teeth portion on both sides of an arc surface thereof, and a sliding surface is formed between two teeth portions. The ratchet has a shaft rod that is configured to be insert into the through hole, so that the ratchet can be pivotally disposed in the semi-circular trough. A fixed trough and a switching trough are formed in the control ring, and the control ring is disposed onto the cylinder of the first body to enable the switching trough to be disposed against the ball. A resilient unit is disposed inside the fixed trough, and one end of the resilient unit is disposed against the sliding surface of the ratchet. Also, the control ring has a rough outer surface, so the control ring can be easily operated. The second body has a receiving space and a ring teeth portion is formed inside the receiving space. The receiving space is used to cover the cylinder of the first body, so the ring teeth portion can be engaged with the teeth portion of the ratchet. A cut trough is formed at an opposite end of receiving space 41 and a through opening is formed on both sides of the cut trough, so the cut trough and the through opening can be used to connected a handle (not shown). Also, a second through hole is formed at a bottom surface of the cut trough toward the receiving space and a screw is used to insert into the screw hole through the through hole to connect the first body and the second body, so the second body can drive the teeth portion of the ratchet via the ring teeth portion and further drive the first body.

In another embodiment a slot is formed at the other end of the cylinder of the first body, and a through hole is formed on both sides of the slot, so the slot and through hole can be used to connect a handle. Also, the other end of the receiving space has a polygonal stick connecting to a sleeve. Namely, the operation of the ratchet connector in the present invention remains the same when the role of the first body and the second body has been changed.

A main objective of the present invention is that the ratchet can be pivotally disposed in the semi-circular trough through the shaft rod and the first body is covered by the control ring and second body and the control ring is used to control the rotation direction of the ratchet, so that the teeth portion can engage with the ring teeth portion. When the second body is rotated against the direction of engagement of the teeth portion and ring teeth portion, the ring teeth portion pushes outer portion of the teeth portion to increase the extent of rotation of the ratchet to push the semi-circular trough of the first body. Furthermore, with the shaft rod and the semi-circular trough, the second body can drive the cylinder to enable the first body to move at the same time without breaking the teeth portions.

A second objective of the present invention is that the ratchet is pivotally disposed in the first body through the shaft rod and the cylinder is covered by the control ring and the second body to quickly assemble the components. The ratchet connector can also be assembled by the screw or C-shaped ring.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
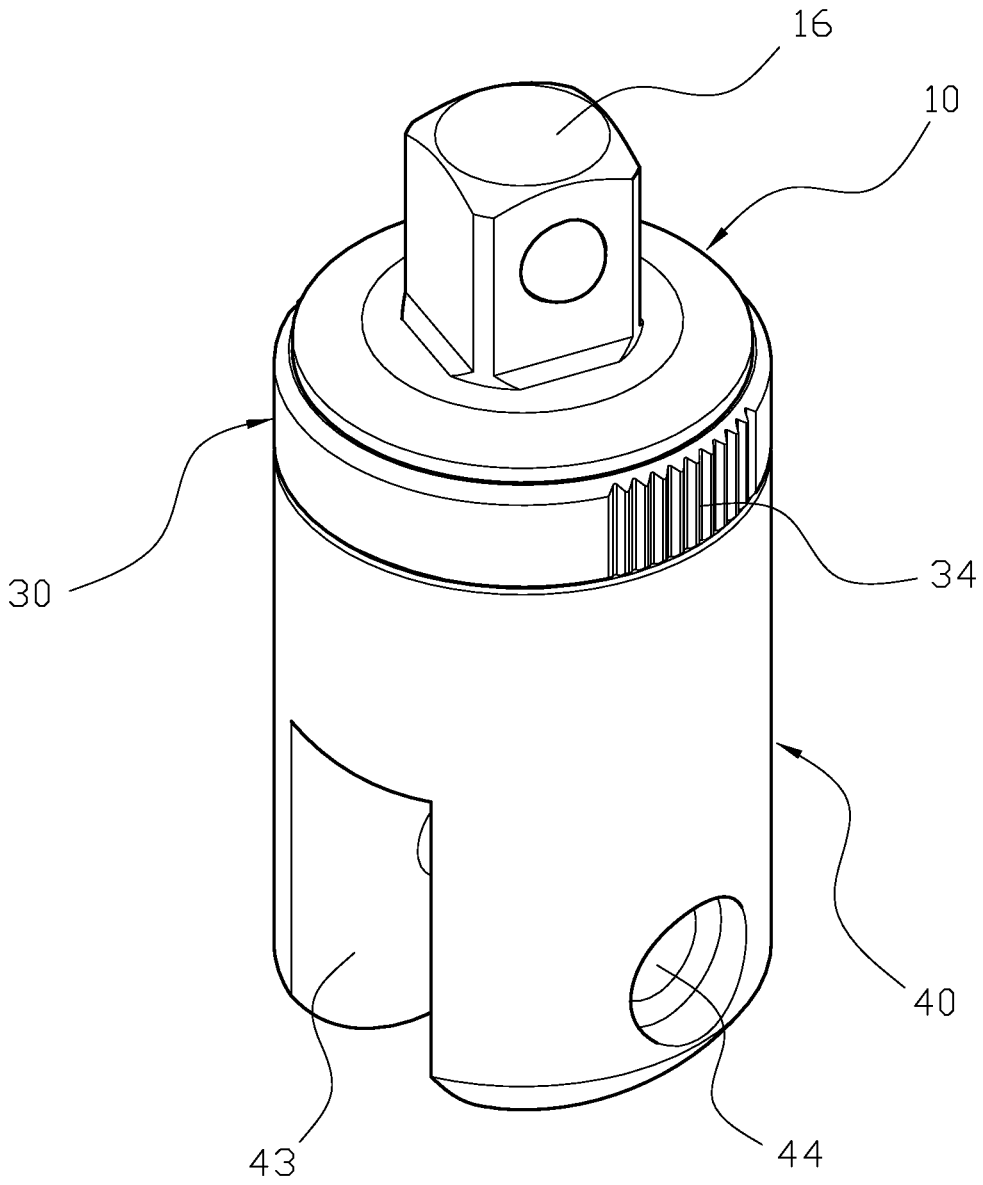
FIG. 1 illustrates a three-dimensional view of the present invention.
Figure 2:
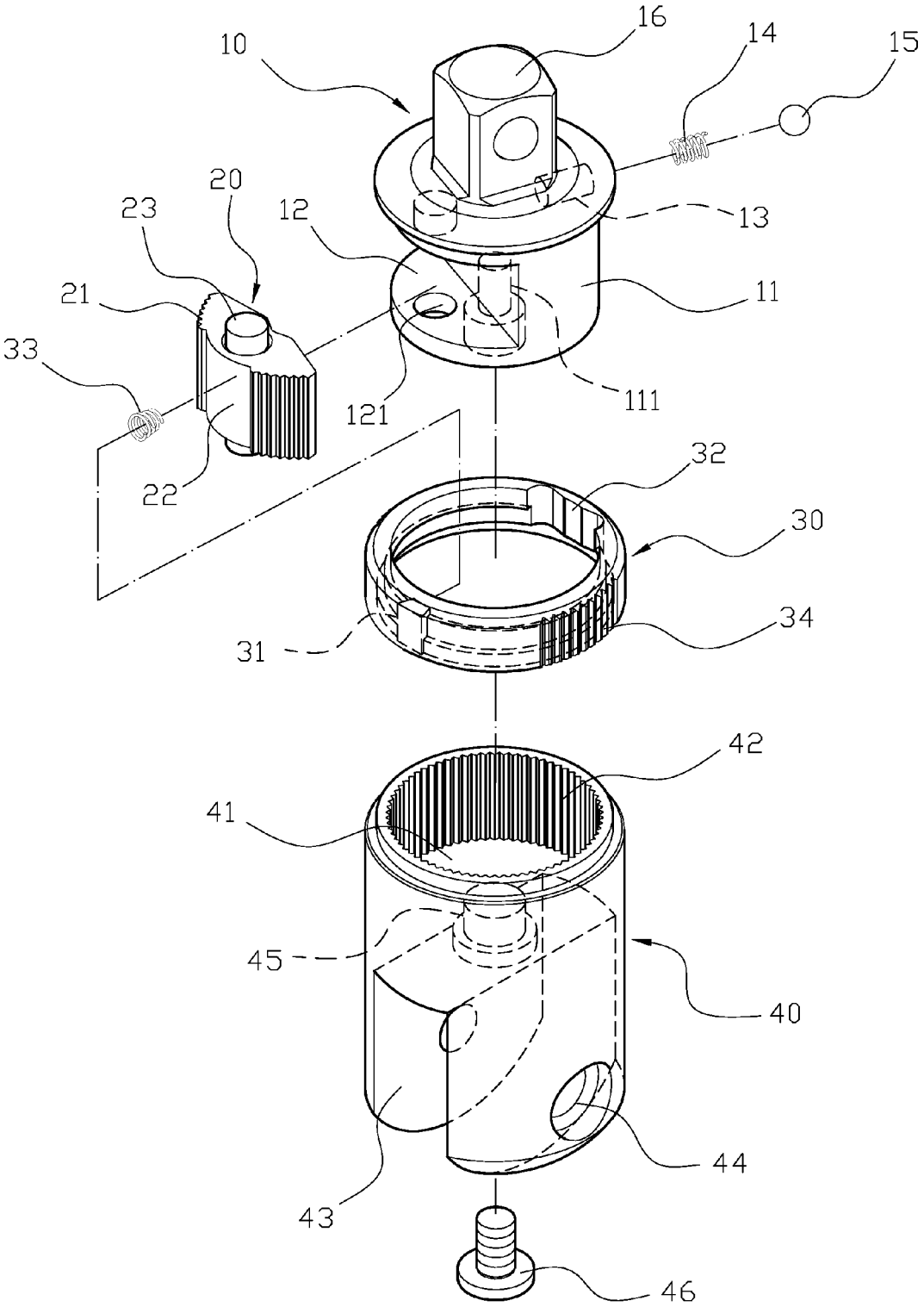
FIG. 2 illustrates an exploded view of the present invention.

In order to further understand the goal, characteristics and effect of the present invention, a number of embodiments along with the drawings are illustrated as following:

Referring to FIGS. 1 and 2, a ratchet connector may include a first body 10, a ratchet 20, a control ring 30 and a second body 40. The first body 10 has a cylinder 11 at one end and a screw hole 111 is formed on a top surface of the cylinder 11. A semi-circular trough 12 is formed at an outer surface of the cylinder 11 and a through hole 121 that has the same axial direction as the cylinder 11 is formed at the semi-circular trough 12, and a through aperture 13 is formed to orderly receive a spring 14 and a ball 15. The other end of the cylinder 11 has a polygonal rod 16 to connect to a sleeve (not shown). The ratchet 20 is fan-shaped and has a teeth portion 21 on both sides of an arc surface thereof, and a sliding surface 22 is formed between two teeth portions 21. The ratchet 20 has a shaft rod 23 that is configured to be insert into the through hole 121, so that the ratchet 20 can be pivotally disposed in the semi-circular trough 12. A fixed trough 31 and a switching trough 32 are formed in the control ring 30, and the control ring 30 is disposed onto the cylinder 11 of the first body 10 to enable the switching trough 32 to be disposed against the ball 15. A resilient unit 33 is disposed inside the fixed trough 31, and one end of the resilient unit 33 is disposed against the sliding surface 22 of the ratchet 20. Also, the control ring 30 has a rough outer surface, so the control ring 30 can be easily operated. The second body 40 has a receiving space 41 and a ring teeth portion 42 is formed inside the receiving space 41. The receiving space 41 is used to cover the cylinder 11 of the first body 10, so the ring teeth portion 42 can be engaged with the teeth portion 21 of the ratchet 20. A cut trough 43 is formed at an opposite end of receiving space 41 and a through opening 44 is formed on both sides of the cut trough 43, so the cut trough 43 and the through opening 44 can be used to connected a handle (not shown). Also, a second through hole 45 is formed at a bottom surface of the cut trough 43 toward the receiving space 41 and a screw 46 is used to insert into the screw hole 111 through the through hole 45 to connect the first body 10 and the second body 40, so the second body 40 can drive the teeth portion 21 of the ratchet 20 via the ring teeth portion 42 and further drive the first body 10.

Figure 3:
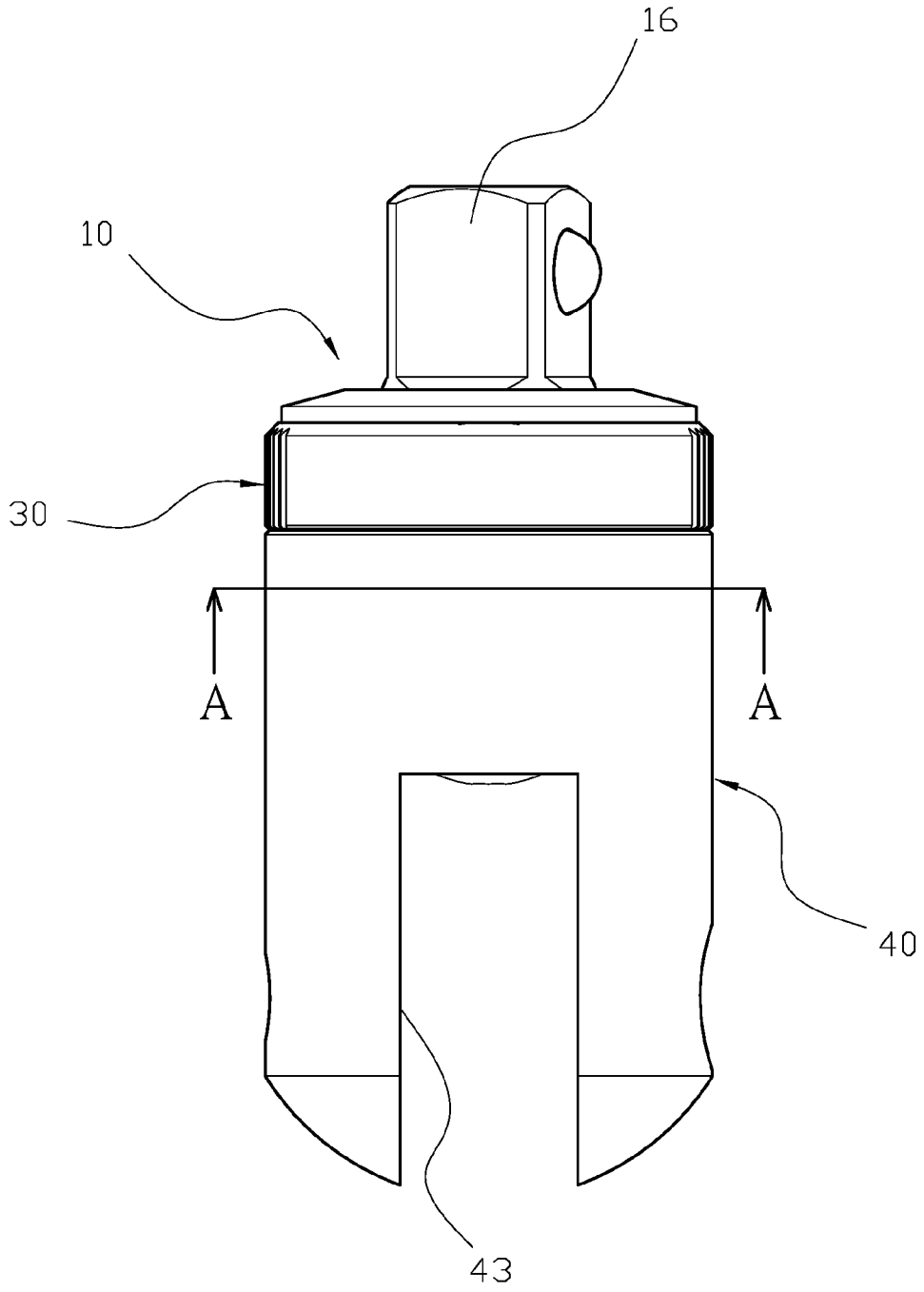
FIG. 3 illustrates a lateral view of the present invention.
Figure 4:
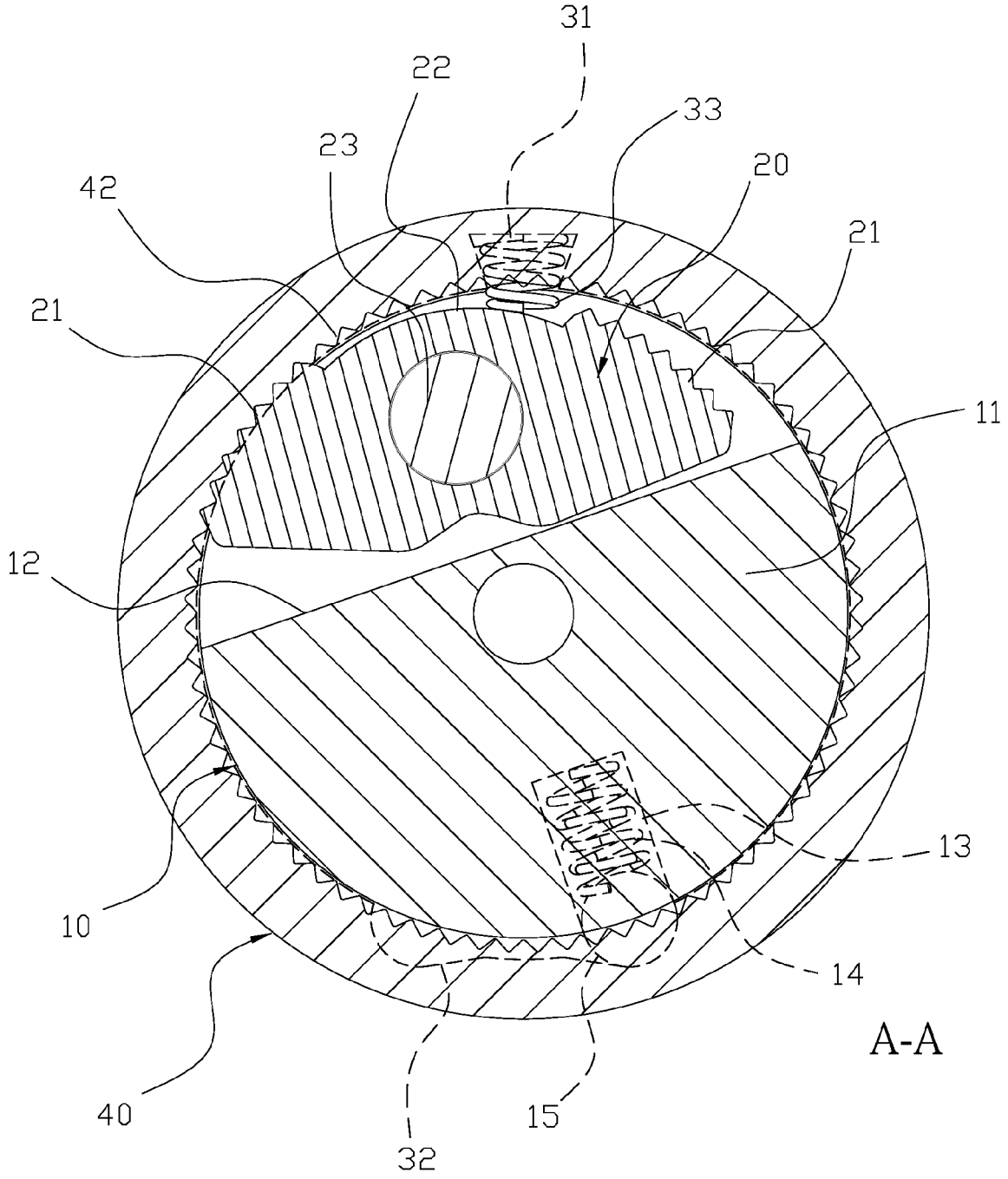
FIG. 4 illustrates a sectional view along line A-A in FIG. 3.
Figure 5:
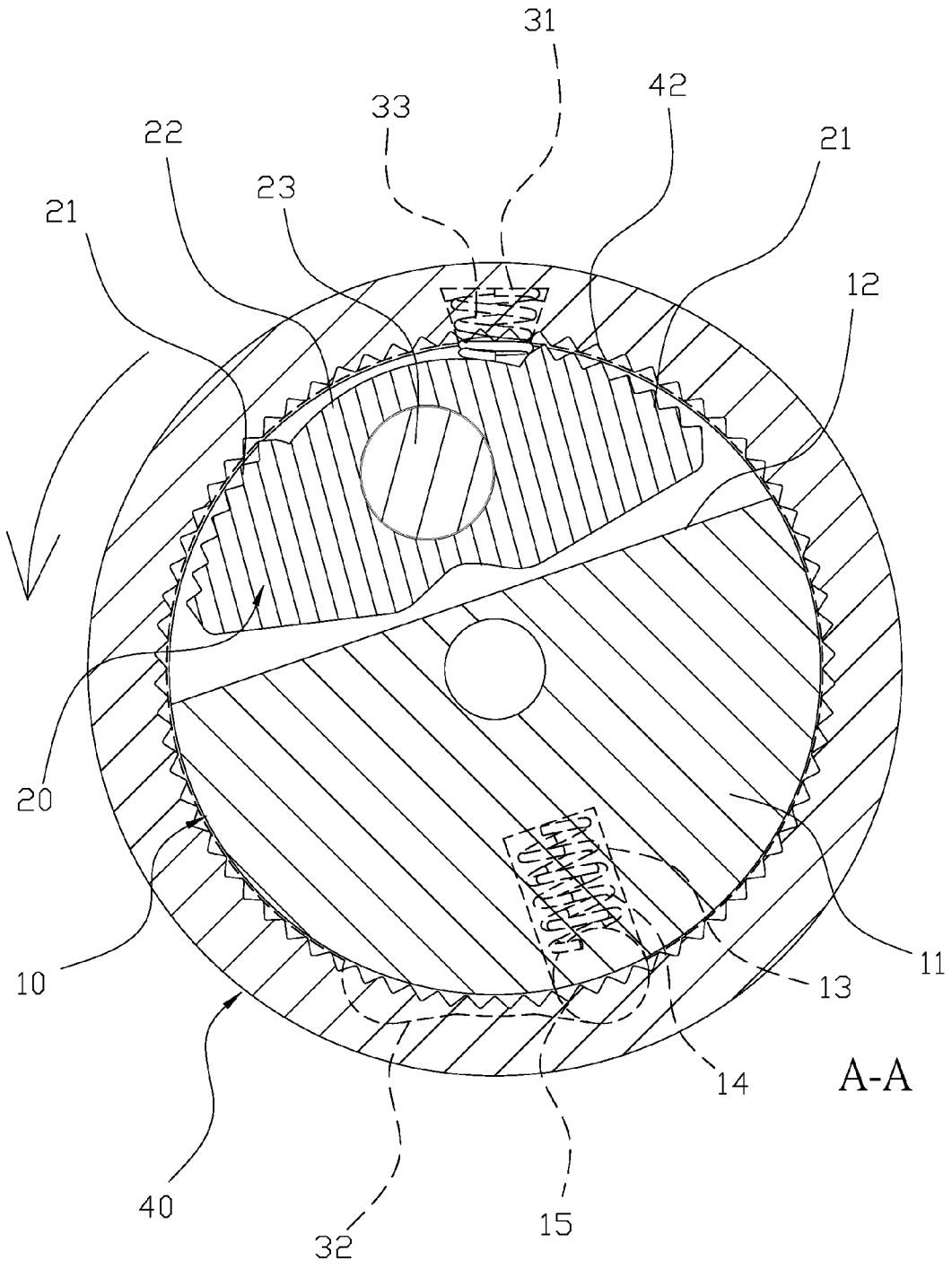
FIG. 5 illustrates a first schematic sectional view along line A-A in FIG. 3.
Figure 6:
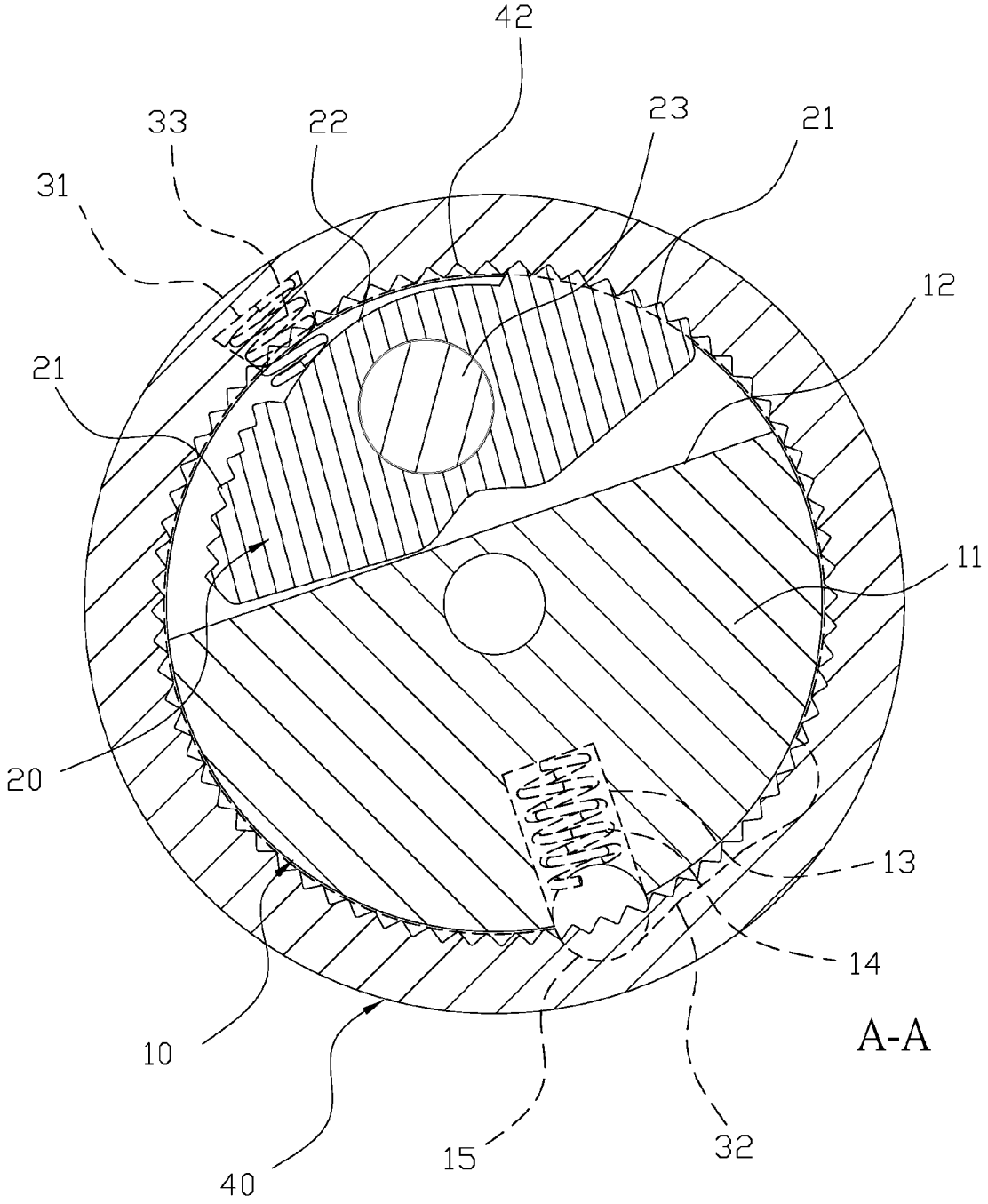
FIG. 6 illustrates a second schematic sectional view along line A-A in FIG. 3.
Figure 7:
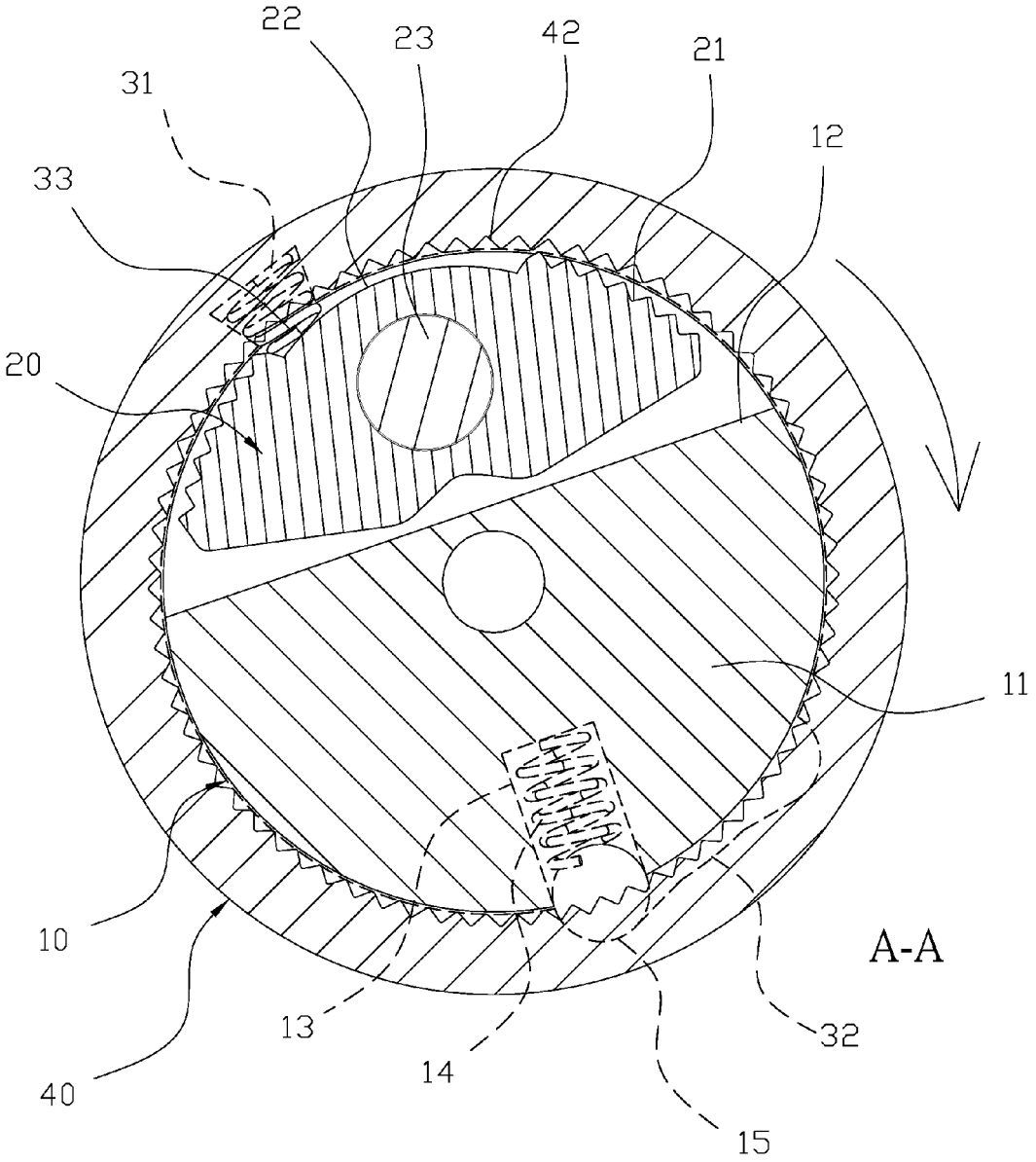
FIG. 7 illustrates a third schematic sectional view along line A-A in FIG. 3.

Referring to FIGS. 2 to 4 when in use, the sliding surface 22 of the ratchet 20 can be inserted in to the semi-circular trough 12 of the first body 10 and the ratchet 20 is pivotally connected with the first body 10 when shaft rod 23 is inserted into the through hole 121. The spring 14 and the ball 15 are orderly disposed into the through aperture 13 and the control ring 30 is used to cover the cylinder 11 of the first body 10, so that the ball 15 can be disposed against the switching trough 32 of the control ring 30. The resilient unit 33 can be fixed at the fixed trough 31 of the control ring 30, so one end of the resilient unit 33 can be disposed against the sliding surface 22 of the ratchet 20 to control the direction thereof. The receiving space 41 of the second body 40 covers the cylinder 11 of the first body 10 to enable the control ring 30 to be disposed between the first body (10) and the second body (40). The teeth ring 42 of the second body 40 can be used to engage the teeth portion 21 of the ratchet 20, and the screw 46 is configured to pass through the through opening 45 of the second body 40 and secured in the screw hole 111 of the first body 10, so that the first body (10), second body (40) and control ring (30) can all rotate by themselves. Referring to FIGS. 4 and 5, the user can spin the control ring 30 through the rough surface 34, so the resilient unit 33 can slide toward one side of the sliding surface 22 of the ratchet 20. Meanwhile, the resilient unit 33 pushes one side of the ratchet 20 so the ratchet 20 can rotate based on the shaft rod 23 and the teeth portion 21 can engage with the ring teeth portion 42 of the second body 40. Also, the spring 14 is disposed against the ball 15 that is disposed against the switching trough 32 of the control ring 30, so the ratchet 20, control ring 30 and the first body 10 can be relatively restricted. When the second body 40 is rotated against the direction of engagement of the teeth portion 21 and ring teeth portion 42, the ring teeth portion 42 pushes outer portion of the teeth portion 21 to increase the extent of rotation of the ratchet 20 to push the semi-circular trough 12 of the first body 10, so the first and second bodies can move together. When the second body 40 is rotated along the direction of engagement of the teeth portion 21 and ring teeth portion 42, the ring teeth portion 42 pushes inner portion of the teeth portion 21 to reduce the extent of rotation of the ratchet 20 and further escape from the ring teeth portion 42, so the second body 40 cannot move together with the first body 10 to generate an effect of unidirectional movement. Referring to FIGS. 6 and 7, if the user wishes to change the direction of the unidirectional movement, the user can spin the control ring 30 toward an opposite direction, so that the resilient unit 30 can be disposed against the other side of the ratchet 20, namely changing the engagement angle between the ratchet 20 and ring teeth portion 42.

Figure 8:
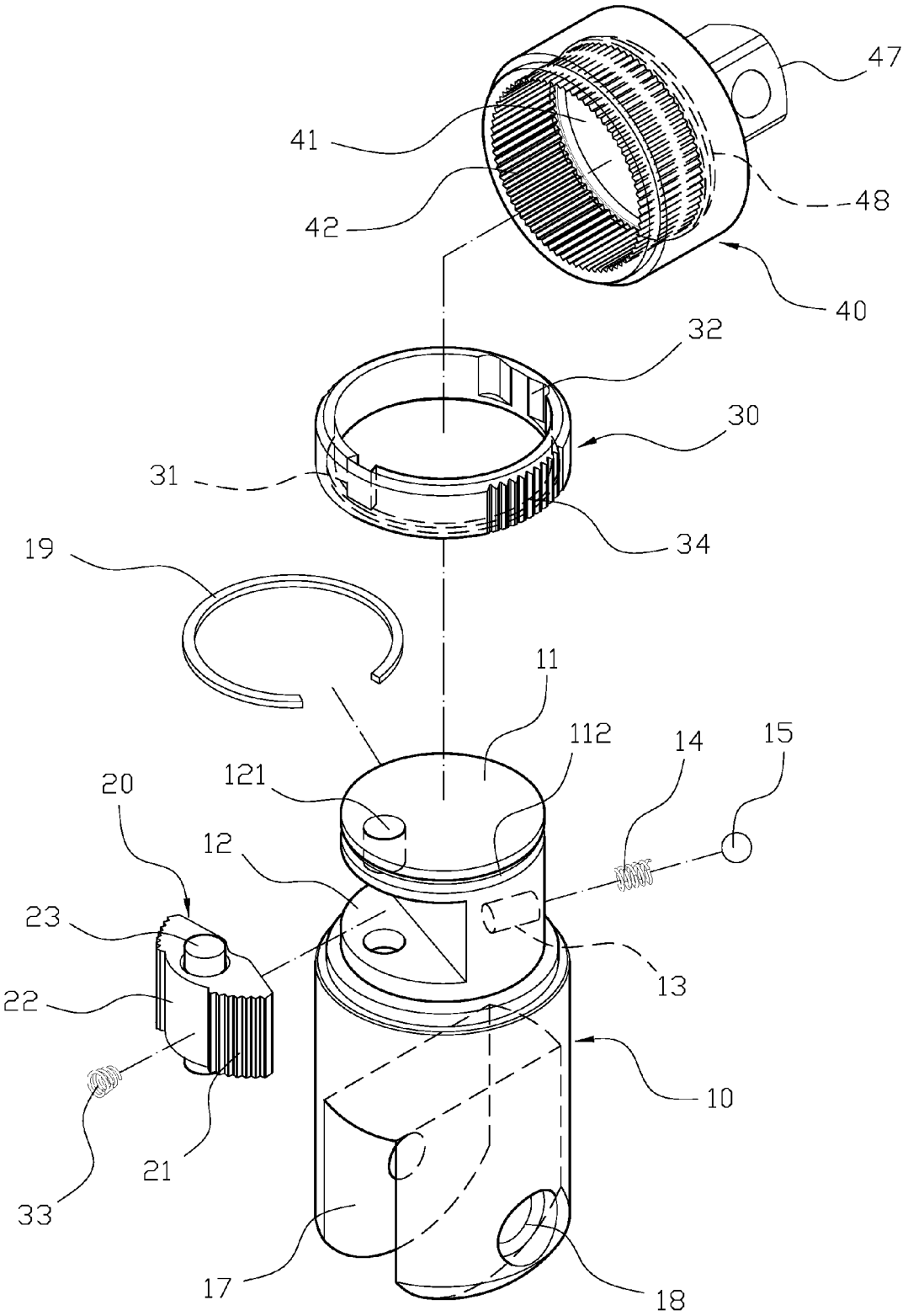
FIG. 8 is an exploded view of another embodiment in the present invention.

In another embodiment shown in FIG. 8, a slot 17 is formed at the other end of the cylinder 11 of the first body 10, and a through hole 18 is formed on both sides of the slot 17, so the slot 17 and through hole 18 can be used to connect a handle (not shown). Also, the other end of the receiving space 41 has a polygonal stick 47 connecting to a sleeve. Namely, the operation of the ratchet connector in the present invention remains the same when the role of the first body 10 and the second body 40 has been changed. On the other hand, a ring slot 112 is formed is formed on top of the cylinder 11 and a C-shaped ring 19 is engaged with the ring slot 112, and a second ring slot 48 is formed at bottom portion of the receiving space 41, so the C-shaped ring 19 is configured to be disposed between the first ring slot 112 and second ring slot 48 to quickly connect the first and second body.

According to the embodiments described above, the present invention is advantageous because (i) the ratchet 20 can be pivotally disposed in the semi-circular trough 12 through the shaft rod 23 and the first body 10 is covered by the control ring 30 and second body 40 and the control ring 30 is used to control the rotation direction of the ratchet, so that the teeth portion 21 can engage with the ring teeth portion 42. When the second body 40 is rotated against the direction of engagement of the teeth portion 21 and ring teeth portion 42, the ring teeth portion 42 pushes outer portion of the teeth portion 21 to increase the extent of rotation of the ratchet 20 to push the semi-circular trough 12 of the first body 10. Furthermore, with the shaft rod 23 and the semi-circular trough 12, the second body 40 can drive the cylinder 11 to enable the first body 10 to move at the same time without breaking the teeth portions; and (ii) the ratchet 20 is pivotally disposed in the first body 10 through the shaft rod 23 and the cylinder 11 is covered by the control ring 30 and the second body 40 to quickly assemble the components. The ratchet connector can also be assembled by the screw 46 or C-shaped ring 19.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A ratchet connector comprising:

a first body having a cylinder at one end and a semi-circular trough formed at an outer surface of the cylinder and a through hole that has the same axial direction as the cylinder formed at the semi-circular trough, and a through aperture formed to orderly receive a spring and a ball;

a ratchet that is fan-shaped and having a teeth portion on both sides of an arc surface thereof, a sliding surface formed between two teeth portions, a shaft rod configured to be insert into the through hole to enable the ratchet to be pivotally disposed in the semi-circular trough;

a control ring having a fixed trough and a switching trough and the control ring disposed onto the cylinder of the first body to enable the switching trough to be disposed against the ball, a resilient unit disposed inside the fixed trough, and one end of the resilient unit disposed against the sliding surface of the ratchet; and a second body having a receiving space and a ring teeth portion is formed inside the receiving space, and the receiving space used to cover the cylinder of the first body to engage the ring teeth portion with the teeth portion of the ratchet.

2. The ratchet connector of claim 1, wherein the other end of the cylinder has a polygonal rod to connect to a sleeve and a cut trough is formed at an opposite end of receiving space and a through opening is formed on both sides of the cut trough, so the cut trough and the through opening are used to connected a handle.

3. The ratchet connector of claim 2, wherein a screw hole is formed on a top surface of the cylinder, and a second through hole is formed at a bottom surface of the cut trough toward the receiving space and a screw is used to insert into the screw hole through the through hole to connect the first body and the second body.

4. The ratchet connector of claim 1, wherein a slot is formed at the other end of the cylinder of the first body, and a through hole is formed on both sides of the slot, so the slot and through hole are used to connect a handle, and the other end of the receiving space has a polygonal stick connecting to a sleeve.

5. The ratchet connector of claim 4, wherein a ring slot is formed is formed on top of the cylinder and a C-shaped ring is engaged with the ring slot, and a second ring slot is formed at bottom portion of the receiving space, so the C-shaped ring is configured to be disposed between the first ring slot and second ring slot to quickly connect the first and second body.

6. The ratchet connector of claim 1, wherein a rough surface is formed outside the control ring.

* * * * *